US008480088B2

(12) United States Patent
Toyama et al.

(10) Patent No.: US 8,480,088 B2
(45) Date of Patent: Jul. 9, 2013

(54) FLUSH MOUNTING FOR CARD SHUFFLER

(75) Inventors: Hirohide Toyama, Darien, IL (US); Stephen C. Jones, Austin, TX (US)

(73) Assignee: Shuffle Tech International LLC, Chicago, IL (US)

( * ) Notice: Subject to any disclaimer, the term of this patent is extended or adjusted under 35 U.S.C. 154(b) by 590 days.

(21) Appl. No.: 12/485,599

(22) Filed: Jun. 16, 2009

(65) Prior Publication Data

US 2009/0314188 A1 Dec. 24, 2009

Related U.S. Application Data

(60) Provisional application No. 61/074,867, filed on Jun. 23, 2008.

(51) Int. Cl.
*A63F 1/12* (2006.01)

(52) U.S. Cl.
USPC ..... 273/149 R

(58) Field of Classification Search
None
See application file for complete search history.

(56) References Cited

U.S. PATENT DOCUMENTS

| | | | | |
|---|---|---|---|---|
| 2,430,681 | A | 11/1947 | Johnson | |
| 2,717,782 | A | 9/1955 | Droll | |
| 3,422,774 | A * | 1/1969 | Hagans | 108/23 |
| D224,658 | S | 8/1972 | Cole et al. | |
| 4,951,950 | A | 8/1990 | Normand et al. | |
| 5,096,107 | A * | 3/1992 | VanSon | 224/328 |
| 5,397,133 | A | 3/1995 | Penzias | |
| 6,651,985 | B2 * | 11/2003 | Sines et al. | 273/309 |
| 7,255,642 | B2 * | 8/2007 | Sines et al. | 463/13 |
| 7,261,294 | B2 * | 8/2007 | Grauzer et al. | 273/149 R |
| D578,577 | S | 10/2008 | Toyama | |
| 7,677,565 | B2 * | 3/2010 | Grauzer et al. | 273/149 R |
| 7,753,373 | B2 * | 7/2010 | Grauzer et al. | 273/149 R |
| 7,766,332 | B2 * | 8/2010 | Grauzer et al. | 273/149 R |
| 7,854,430 | B2 * | 12/2010 | Toyama | 273/149 R |
| 8,038,521 | B2 * | 10/2011 | Grauzer et al. | 463/17 |
| 8,070,574 | B2 * | 12/2011 | Grauzer et al. | 463/11 |
| 2005/0104290 | A1 * | 5/2005 | Grauzer et al. | 273/149 R |
| 2007/0069462 | A1 * | 3/2007 | Downs et al. | 273/149 R |
| 2007/0194524 | A1 | 8/2007 | Toyama et al. | |
| 2008/0006997 | A1 * | 1/2008 | Scheper et al. | 273/149 R |
| 2008/0315517 | A1 | 12/2008 | Toyama | |
| 2010/0225056 | A1 * | 9/2010 | Grauzer et al. | 273/149 R |
| 2010/0244382 | A1 * | 9/2010 | Snow | 273/292 |
| 2010/0276880 | A1 * | 11/2010 | Grauzer et al. | 273/149 R |
| 2011/0233863 | A1 * | 9/2011 | Toyama | 273/149 R |

OTHER PUBLICATIONS http://www.calicolaine.co.uk/haberdasherytips/products/felt-baize-self-adhesive-felt.html.*

* cited by examiner

*Primary Examiner* — Kurt Fernstrom
*Assistant Examiner* — Dolores Collins
(74) *Attorney, Agent, or Firm* — Brinks Hofer Gilson & Lione

(57) ABSTRACT

An apparatus and method for mounting a shuffling apparatus to a table is described. A bezel plate has an aperture permitting access to a top aperture in a shuffler apparatus. An aperture in the table top is covered by the bezel plate and a top portion of the shuffler apparatus is accessible through an aperture in the bezel plate. The bezel plate may be captivated to the table top using straps extending through the aperture in the table top and being affixed to the underside of the table top. The shuffler may be supported against the underside of the bezel plate by a bracket affixed to the underside of the table top. Alternatively, the bezel plate may be placed on the table top and the shuffler hung from an underside of the bezel plate by a bracket extending through the aperture in the table top.

9 Claims, 7 Drawing Sheets

FLUSH MOUNTING FOR CARD SHUFFLER

This application claims the benefit of U.S. provisional application No. 61/074,867, filed on Jun. 23, 2008, which is incorporated herein by reference.

This application is related to U.S. Ser. No. 12/121,484, filed on May 15, 2008, published as US 2008-0315517 on Dec. 15, 2008, which is a continuation-in-part of U.S. Ser. No. 11/706,707, filed on Feb. 15, 2007, now U.S. Pat. No. 7,900,923, issued Mar. 8, 2011, and which claims the benefit of U.S. provisional application Ser. No. 60/755,260, filed on Feb. 21, 2006, each of which is incorporated herein by reference. This application is also related to US design patent application Ser. No. 29/294,563, filed Jan. 17, 2008, now U.S. Pat. No. D 578,577, issued on Oct. 14, 2008, which is incorporated herein by reference.

TECHNICAL FIELD

This application relates to an apparatus and method for mounting an apparatus for preparing playing cards for use.

BACKGROUND

Various games are played using playing cards, where a typical game may use one or more decks of cards, which may have 52 cards of various values and suits. Other card games may use different numbers of cards, and some games may be played with multiple decks of cards. Various mechanical means of performing operations which may have the effect of randomizing the deck of cards are known.

SUMMARY

An apparatus for mounting a card shuffler to a table top is described, including a plate having an aperture in a surface thereof, the aperture having planar dimensions greater than planar dimensions of a card of a deck of cards and having an outer periphery sized and dimensioned to cover an aperture formed in the table top. A support mechanism is configured to position an aperture in a top of the shuffler so that the aperture in the top of the shuffler is oriented to be accessible through the aperture in the plate when the apparatus is mounted to the table top.

In an aspect, an apparatus for mounting a card shuffler to a table top includes a plate having an aperture in a surface thereof, the aperture having planar dimensions greater than planar dimensions of a card of a deck of cards; and, a plurality of holes in the plate, each hole spaced from a outer edge of the plate a distance sufficient for an inserted fastener to pass through an aperture in a table surface. The card shuffler may have a plurality of structures having a same planar spatial pattern as the holes in the plate. Bolts inserted in the holes couple to the structures so as to captivate the shuffler to the plate.

In another aspect an apparatus for mounting a shuffler to a planar surface includes, a plate having an aperture in a surface thereof, each planar dimension of the aperture being greater than a corresponding planar dimension of a card of a deck of cards; and, a bracket attachable to an underside of the plate, and projectable through an aperture in the planar surface. The bracket supports the shuffler so that an aperture in the top of the shuffler is accessible thought the aperture in the plate.

In yet another aspect an apparatus for mounting a card shuffler to a table top includes a plate, sized and dimensioned so as to mask a periphery of an aperture in the table top, and having an aperture therein sized and dimensioned to accommodate a card of a deck of cards disposed parallel to the plate. A largest peripheral dimension of the aperture in the table top is smaller than a largest corresponding peripheral dimension of the card shuffler in a plane parallel to the table top. A shuffler support captivates the shuffler to the plate, which is captivated to the table top.

A gaming table is disclosed, including a table top having an aperture formed therein, and a card shuffler assembly. The card shuffler assembly has a card shuffler having an aperture in a top thereof capable of accepting a deck of cards; a plate sized and dimensioned so as to mask a periphery of the aperture in the table top. The plate may have an aperture sized and dimensioned to accommodate a card of the deck of cards, when the card is disposed parallel to the table top. A largest peripheral dimension of the aperture in the table top is smaller than a largest corresponding peripheral dimension of the card shuffler in a plane parallel to the table top. A shuffler support captivates the card shuffler to the table.

A method of mounting a shuffler to a table top is described, including the steps of: providing a table top; cutting an aperture in the table top, sized and dimensioned to accommodate at least a portion of a bezel of a shuffler; and, providing a plate having outer peripheral dimensions so as to mask the aperture; and, an aperture in the plate sized and dimensioned to permit passing a deck of cards through the aperture.

DETAILED DESCRIPTION

Figure 1A:
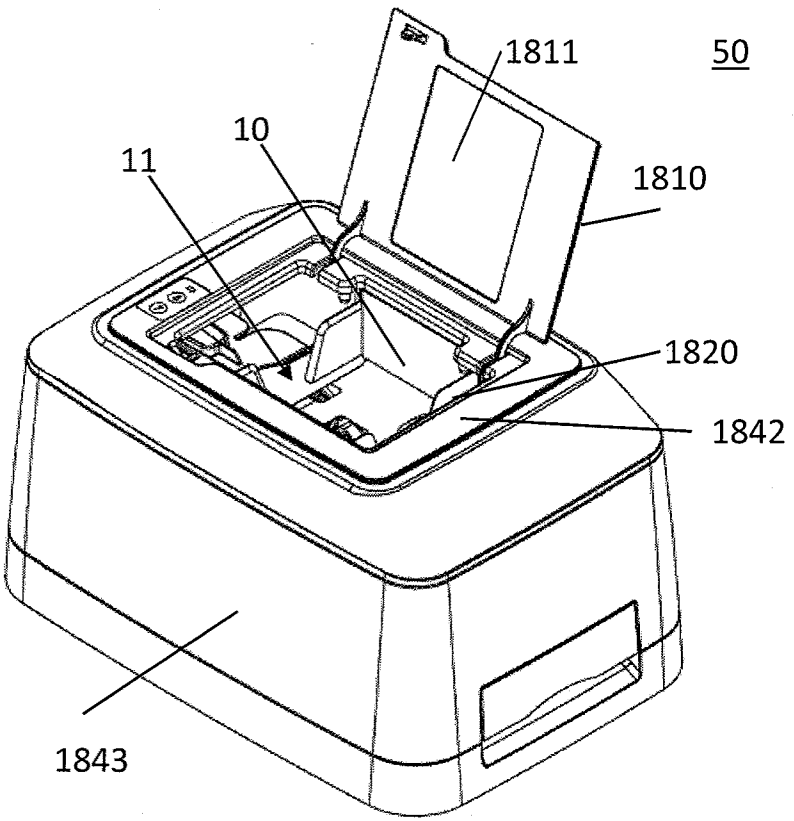
FIG. 1 shows perspective views of an apparatus for shuffling cards, with (A) a cover opened; and, (B) the cover closed and a side drawer partially pulled out.

Exemplary embodiments may be better understood with reference to the drawings, but these examples are not intended to be of a limiting nature. Like numbered elements in the same or different drawings perform equivalent functions. When a specific feature, structure, or characteristic is described in connection with an example, it will be understood that one skilled in the art may effect such feature, structure, or characteristic in connection with other examples, whether or not explicitly stated herein.

An apparatus for preparing a deck of cards for use in a game of cards has been disclosed in U.S. Ser. No. 11/706,707 and a continuation-in-part thereof, U.S. Ser. No. 12/121,484, and the ornamental design of a shuffler in U.S. Pat. No. D 578,577. Other shuffler designs having a top aperture for insertion and removal of cards of a deck of cards may also be mounted to a table as disclosed herein.

In an example, a device for shuffling a deck of cards may have an aperture in the top thereof for insertion or removal of the deck of cards.

The shuffler may include a first compartment which may receive a deck of cards; a second compartment; and, a third compartment. A transport mechanism of the first compartment is operable to dispense cards from a bottom portion of the first compartment to at least one of the second or third compartments and a transport mechanism of at least one of the second or the third compartments is operable to dispense cards from a bottom portion at least one of the second and third compartments to the first compartment. The cards may be dispensed into a card delivery compartment or introduced and removed from the device through a top aperture. When configured for installation in a table top, the shuffler receives and dispenses cards through a top aperture positioned so as to permit introduction of the deck of cards into the first compartment.

Other shuffler devices, having the characteristics of receiving and dispensing cards through an aperture in a top surface thereof may also be used. The shuffler may be placed in proximity to one of the players who may act as the dealer in, for example, a game of poker. Poker tables may have limited surface area and the cards in play and chips occupy a portion of the area. When the shuffler is placed on the table top, an area of the table top may be occupied by the shuffler, and the vision of players of the complete table top may be obscured.

The shuffler may be mounted underneath the table top so that at least a portion of the top aperture of the shuffler is accessible through an opening in the table top or through a table bezel or surround. The table bezel may have an aperture through which all or part of a top portion of the shuffler may be accessed. The shuffler and table bezel may be configured so that a top surface portion of the shuffler, having an aperture through which cards may be inserted or removed, may be substantially flush with the top surface of the table bezel or the table top to which the shuffler may be mounted. Alternatively, a portion of the shuffler may project through the aperture in the table bezel so as to extend above the table top. In another alternative, the table bezel may have a rim disposed between the aperture in the table bezel and the table top to which the table bezel is mounted. This may prevent the inadvertent introduction of cards or fluids into the top surface aperture of the shuffler.

Herein the term "bezel" or "fascia" is to be understood as a surround for a device or part thereof, and may be integral to, separate from, or mounted to, the device. Whether the structure is flat, as in a plate, or has a specific shape, is determined by the context. In the case of the shuffler 50, the term bezel 1840 is used to describe flat surface 1842 and the sloping surface 1842 leading from the top surface 1842 to the side surface 1843. The table bezel 70 may be a generally flat plate, and the term "plate" is also used in this context. The edges of the periphery of the plate may be chamfered or beveled so as to make an esthetically pleasing interface with the surface of the table or the shuffler.

Figure 1B:
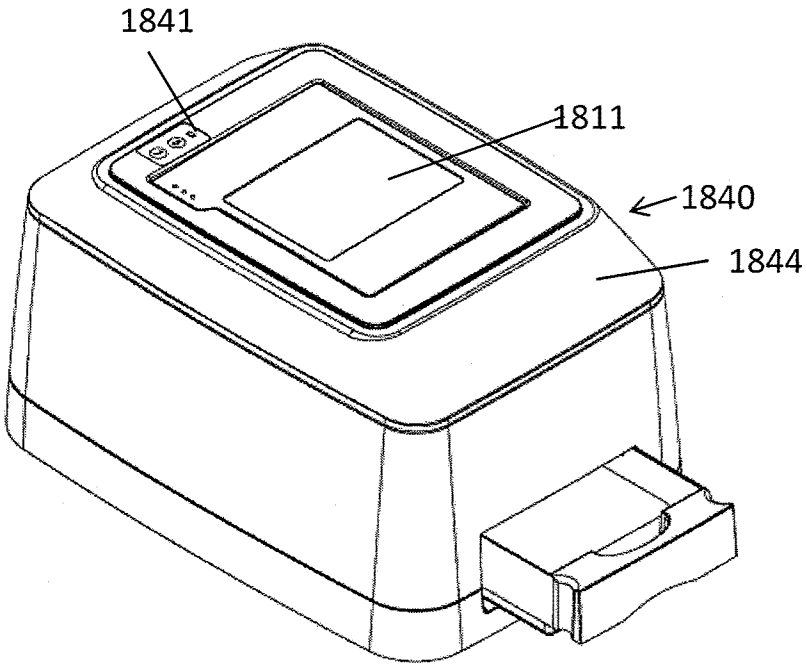

FIG. 1 shows a perspective view of the exterior of an example of a shuffler 50. A top aperture 11 may be closed by a hinged cover 1810, which is shown in an open position in FIG. 1A and in a closed position in FIG. 1B. A deck of cards may be introduced into the shuffler 50 so as to be situated in a central compartment 10, accessible through the aperture 11, when the cover 1810 is in the open position. The cover 1810 may have a transparent portion 1811 through which the status of the cards in the central compartment 10 may be observed. A shuffler bezel 1840 may surround the aperture 11, and the aperture 11 may be defined by an inner periphery 1820 of the shuffler bezel 1840. A portion 1842 of the shuffler bezel 1840 may extend between another portion 1844 of the shuffler bezel 1840 surrounding the aperture 11, and a side surface 1843 of the housing. The side surface 1843 of the body of the shuffler 50 is substantially orthogonal to the base of the shuffler 50 and defines the maximum longitudinal and transverse dimensions thereof. The shuffler bezel 1840 or other exterior surface of the shuffler 50 may and have one or more switches or indicators 1841 disposed thereon so as to control the operation of the shuffler or to provide status indications.

Certain aspects of the shuffler operation may be controlled by the opening and closing of the cover 1810. For example, the cover 1810 may open when a shuffling operation is complete so as to facilitate the removal of shuffled cards. In addition, the shuffler 50 may be configured to start a shuffling process when the cover 1810 is closed and there are cards in the center compartment 10. In another aspect, a cover may be omitted. The aperture 11 may be sized so as to permit the insertion and removal of the deck of cards from the shuffler, and the dimensions of the aperture 11 may be approximately the planar dimensions of the cover 1810.

In yet another aspect, the central compartment 10 may be elevated so as to be positioned above the top surface of the bezel 1840 for the purposes of inserting or removing cards from the shuffler 50 when the shuffling process has completed.

FIGS. 1A and 1B also show a drawer (reference numeral not shown) that may be disposed on a side surface of the shuffler 50 so that cards may be removed from the shuffler 50 when the shuffler 50 is disposed on the surface of a table, or the like. Herein, while the shuffler 50 may have such a drawer, the shuffler is configured by a switch or other control so that the deck of cards introduced into the compartment 10 so as to be shuffled may also be removed from the compartment 10 through the aperture 11 when the cover 1810 is in an open position. The mounting arrangements described in the examples are for the situation where the cards of the deck of cards are inserted and removed from the shuffler 50 through the top aperture 11. A drawer may not be provided.

Figure 2A:
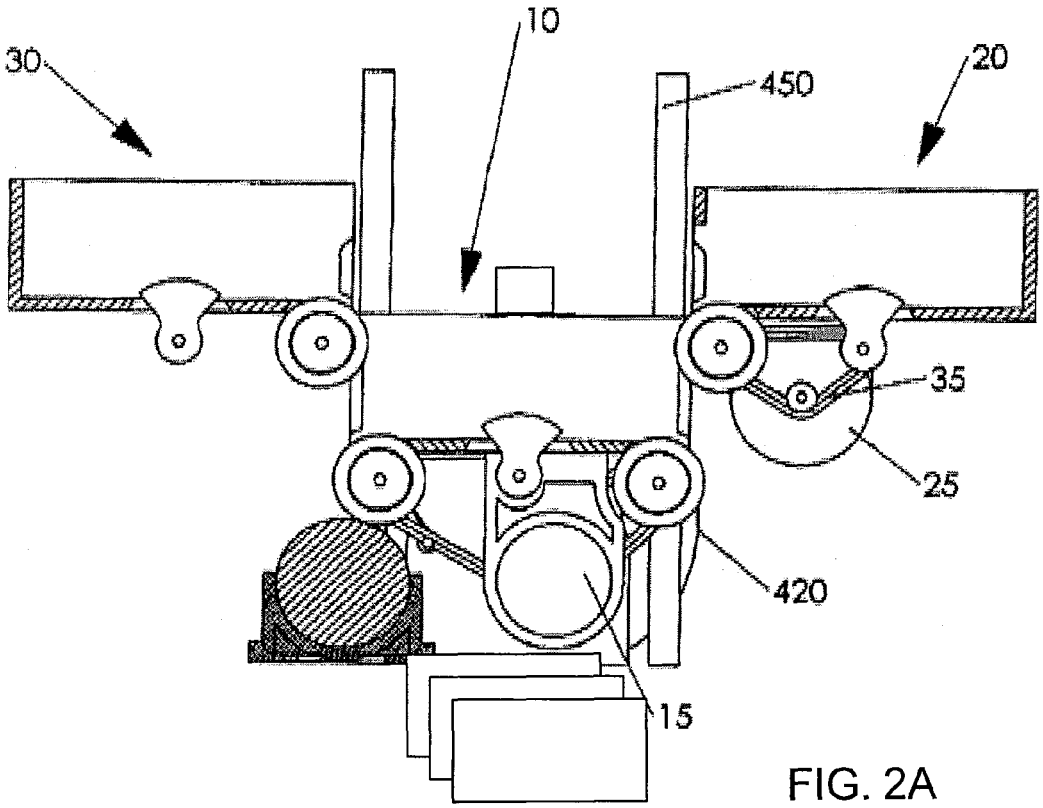
FIG. 2 is a partial elevation cross section view of aspects of the internal mechanism of a card shuffler apparatus with (A) a central card tray in a lower position; and, (B) the central card tray in an upper position.
Figure 2B:
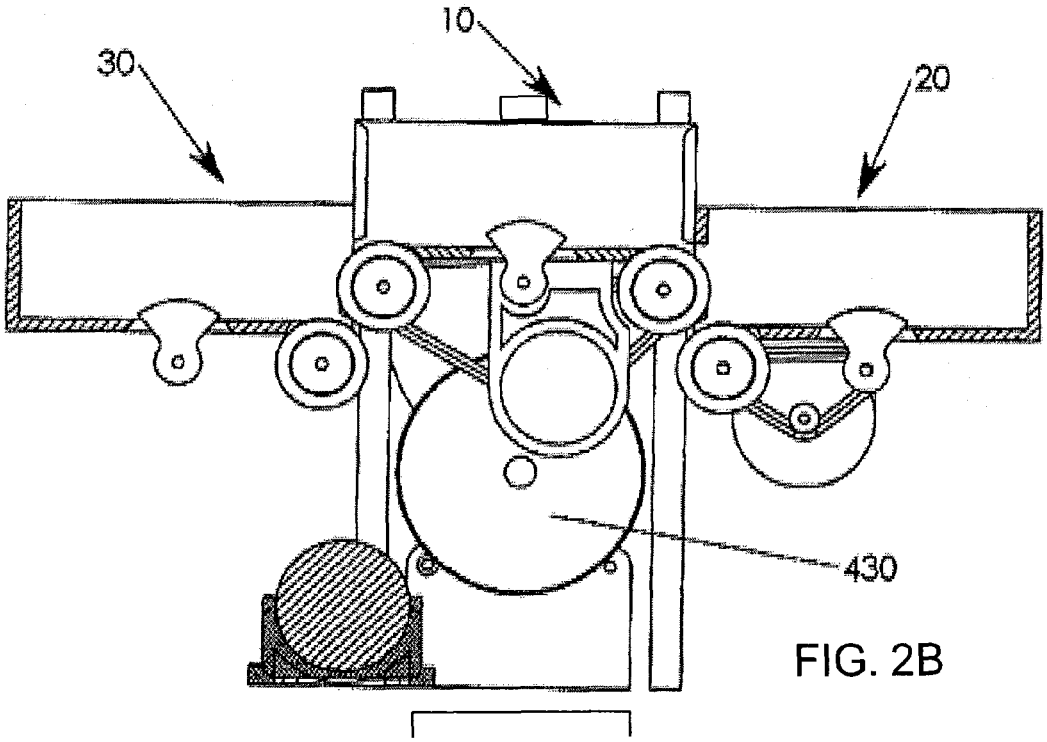

FIGS. 2A and 2B show partial-vertical-cross-section internal views of an example of a shuffler mechanism (with the housing not shown). Three compartments may be disposed inside the shuffler 50. A central compartment 10, a left hand compartment 30 and a right hand compartment 20 may be disposed such that the central compartment 10 may be raised and lowered with respect to the left-hand 30 and right-hand 20 compartments. The operation of this and similar shuffling mechanisms has been described in U.S. Ser. No. 12/121,484. A motor 25 and a drive belt 35 may be a part of a card transport mechanism and, in conjunction with other components may serve to move the cards of a deck of cards between the side compartments 20, 30 and the central compartment 10 under control of a processor or other logic circuit. A similar motor 15 may be a portion of a transport mechanism of the central compartment 10, operable so as to transfer cards between a bottom portion of the central compartment and one or more of the side compartments 20, 30. A gear 420 may be driven by another motor so as to raise and lower the central compartment 10 with respect to the side compartment 20, 30 using, for example, a cam or belt drive.

Other shuffler mechanisms may be used, providing that the deck of cards is removable through a top aperture of the shuffler after completion of the shuffling process.

Figure 3A:
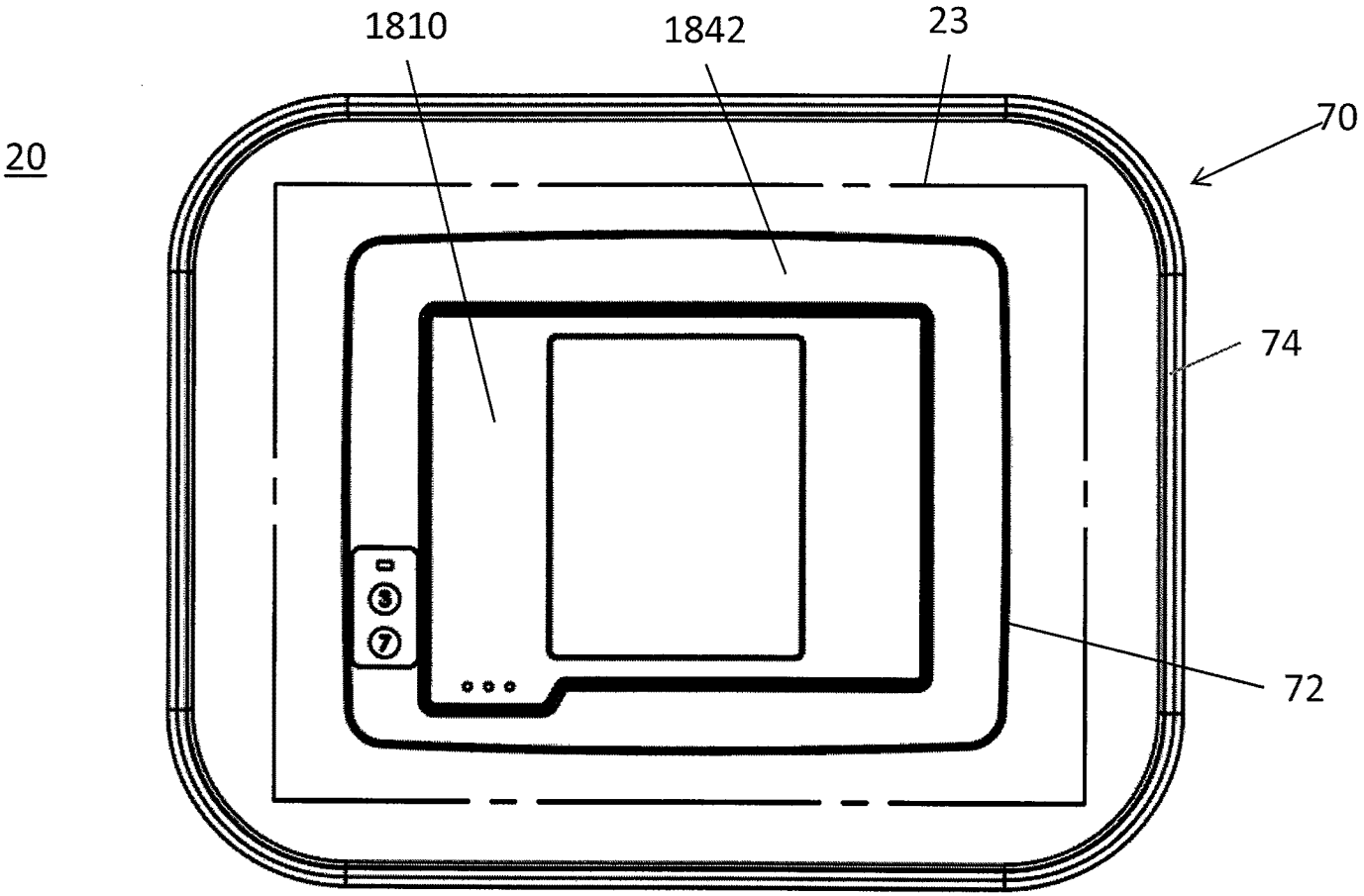
FIG. 3 shows (A) a top view of a portion of a table top having a shuffler device mounted thereto using a table bezel; and, (B) a side elevation cross section view of the table showing the shuffler device positioned with respect to the table bezel.
Figure 3B:
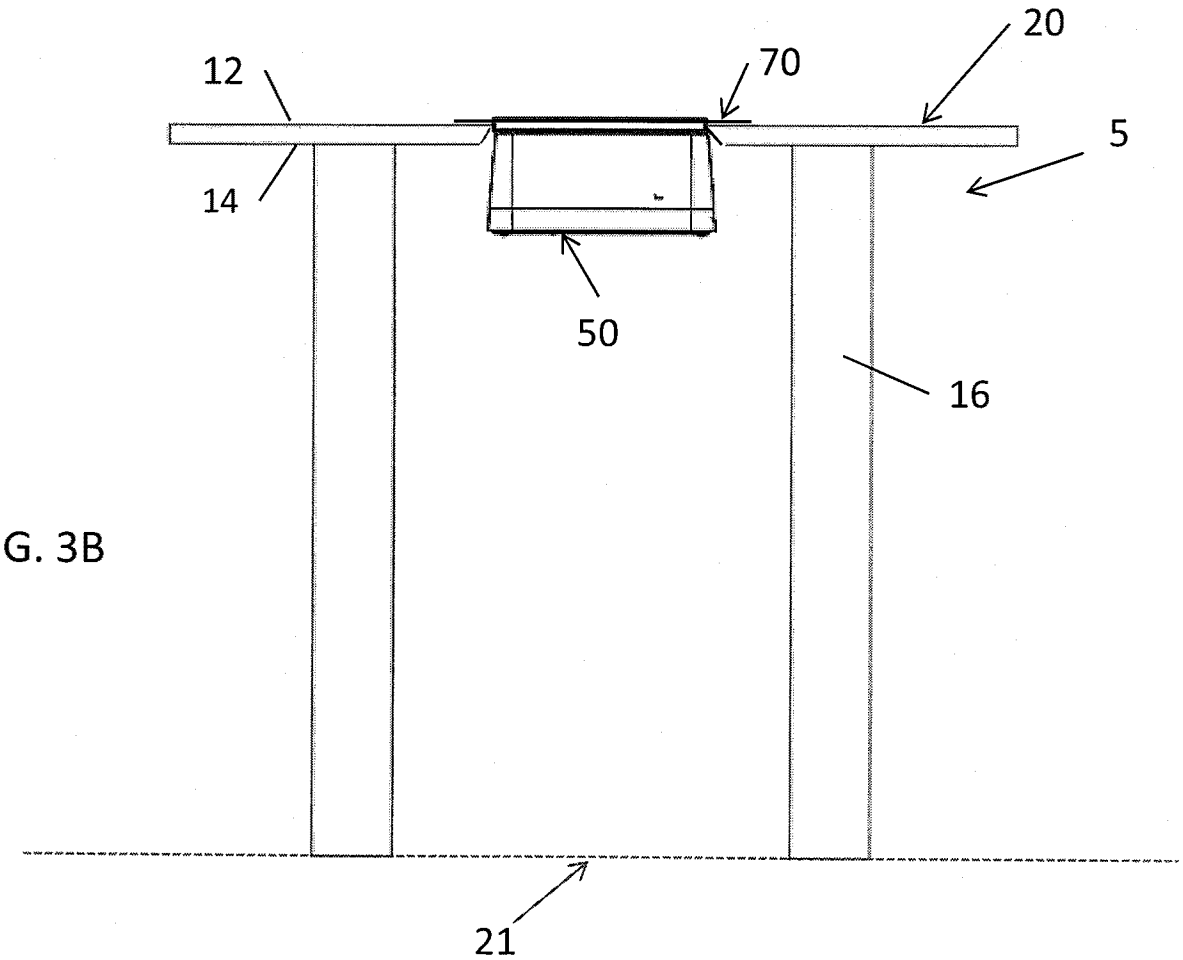

FIGS. 3A and 3B illustrate the mounting of a shuffler 50 to a top 20 of a table 5. A shuffler 50 may be mounted to a table 5 so that a top surface of the shuffler 50 is substantially flush with the top surface 12 of the table top 20 thereof. The table 5 may comprise a table top 20, supported by legs 16 such that the top surface 12 thereof is parallel to the floor 21 of a room. Other structures may be used for supporting the table top 20.

An aperture 23 is provided in the table top 20, extending therethrough between the top surface 12 and a bottom surface 14 thereof and sized and dimensioned so as to permit at least a portion of the shuffler 50 to project through from a bottom surface 14 of the table top 20 so that at least the aperture 11 of the shuffler 50 may be accessed when the shuffler 50 is in an operational position.

Table tops are often made of wood, plywood, or a wood substitute such as composition board. The aperture 23 may be formed in the table top 20 during the manufacturing process, or be cut into the table top 20 at a later time so as to install a shuffler in a completed table. Where plywood is used, a thickness of about ¾" may be typical, although the thickness may vary by manufacturer and model. Where other materials are used, the thickness is determined by engineering factors such as the flexibility of the material and the size of the table top. Table tops of tables intended for use in games of cards may have a covering on the top surface thereof so as to better control the movement of cards, and other game paraphernalia, such as poker chips. Often this surface covering is a baize or wool felt material. For aesthetic reasons, the surface covering may be extended close to the aperture 23, or be arranged such that flaps of the surface covering may be folded into the aperture 23 so that the surface of the table top 20 remains covered by the surface treatment when viewed by the players of the game.

Herein, a surface covering is considered to be an attribute of the top surface 12 of the table top 20, and where a contact with the top surface 12 is described, the surface treatment may be considered to be disposed, for example, between the table bezel 70 and the top surface 12, even if such a situation is not explicitly described.

A surround or table bezel 70, which may be a plate, has an outer periphery 74 sized and dimensioned such that the periphery 74 may be disposed to surround the aperture 23 in the table top 20 similarly oriented in a planar direction. An inner periphery 72 of the table bezel 70 forms an aperture 73. The aperture 73, is sized and dimensioned so that, when the table bezel 70 is symmetrically disposed with respect to the periphery of the aperture 23, the aperture 72 is positioned above the aperture 23. When the shuffler 50 is positioned so that the top cover 1810 thereof is surrounded by the inner periphery 72 of the bezel 70 the top cover 1810 of the shuffler 50 to be opened so as to introduce or remove cards. In an aspect, the aperture 73 may be sized and dimensioned so that all of or a portion of the bezel 1840 of the shuffler 50 may either be visible through or project through the aperture 72. As shown in FIG. 3, the aperture 73 is sized and dimensioned so that the flat top portion 1844 of the shuffler bezel 1840 may be accommodated within the aperture 73.

Where operating controls are positioned on the bezel 1840 or other top portion of the shuffler 50, the aperture 73 may be sized and dimensioned so that the controls may be accessed from the top of the table. In this context, the bezel 1840 may be considered to extend from the opening formed by the aperture 11 in the shuffler top to the portion of the shuffler where the sides 1843 are substantially orthogonal to the top thereof, and to include regions 1842 joining the top portion 1844 the bezel 1840 and the sides 1843 of the shuffler 50. Alternatively, the bezel 1840 may be a flat portion of the top 1843 of the shuffler 50 having the aperture 11, and which may also have one or more operating controls or indicators.

In another aspect, the cover 1810 may be absent, and the cards may be introduced into the central compartment 10 and removed from the central compartment 10 through the aperture 11. The aperture 73 may then be sized and dimensioned such that the cards may be inserted and removed from the central compartment 10, and the aperture 73 may be approximately the size of the plan view of the central compartment 10.

The table bezel 70 may be placed so as to mask the periphery of aperture 23 in the table top 20. The shuffler 50 may be positioned under the table top 20, with a portion of the shuffler 50, projecting through the aperture 23 in the table top 20 from the bottom surface 14 to the top surface 12 thereof, so that the cover 1810 can be opened or the top aperture 11 of the shuffler 50 accessed from above the top surface 12. The shuffler 50 may be held against an under surface of the table bezel 70 by a captivating mechanism.

Figure 4A:
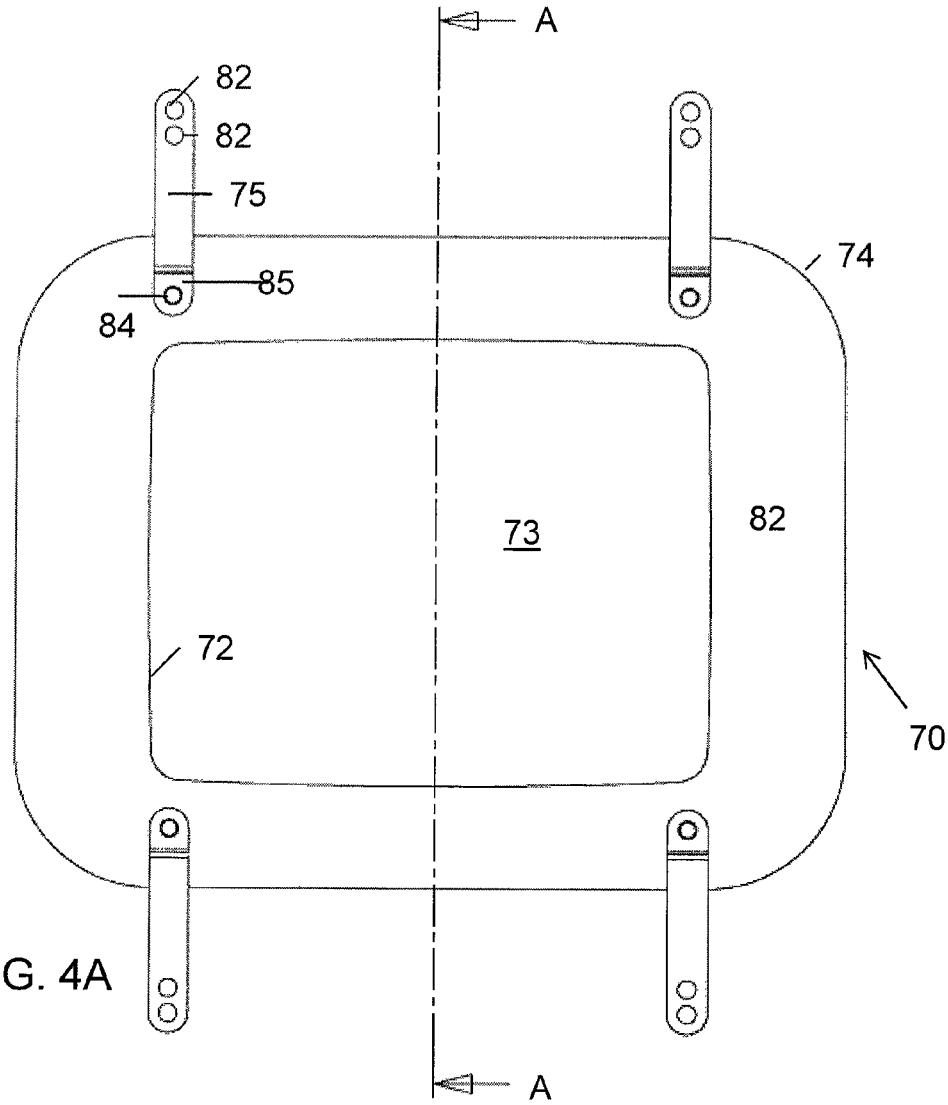
FIG. 4 shows (A) a bottom view of an example of a table bezel; and (B) a side cross section view of the table bezel.
Figure 4B:
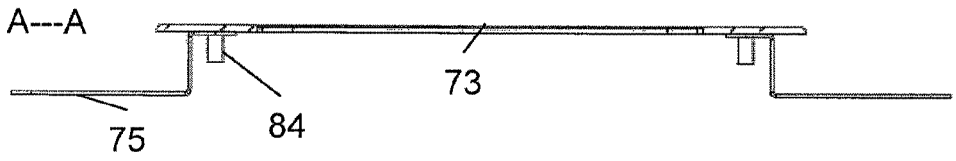

An example of a table bezel 70 is shown in FIG. 4. The table bezel 70 is defined by an outer periphery 74 and an inner periphery 72, creating an aperture 73, and being disposable so as to mask the periphery of the aperture 23 in the table top 20. The table bezel 70 may be fabricated from any suitable engineering material, such as a metal, a plastic, wood, or the like. An upper surface of the bezel 70 may be painted, coated with a plastic material, anodized, or otherwise finished for esthetic or durability reasons. The finishes may include a material such as the baize or wool felt used for the remainder of the table covering, so as to further minimize the visual appearance of the installed shuffler.

The table bezel 70 may be placed so as to mask the aperture 23 and captivated to the top surface 12 of the table top 20. In an example, shown in FIG. 4, a plurality of tabs 75 may be provided at locations around the table bezel 70. The tabs 75 may be fastened to studs 84 mounted to the bottom surface of the bezel 70, and the studs 84 may be spaced inwards from the periphery 74 so that the studs 84 project into the aperture 23 when the table bezel 70 is placed on the top surface 12 of the table top 20. The tab 75 may be a flexible material such as aluminum, copper, steel, or plastic having sufficient strength to resist the forces placed upon it during the mounting and use of the shuffler apparatus 50. A portion of the tab 75 distal from the attachment of the tab 75 to the stud 84 may be provided with one or more holes 82, suitable to accept a bolt or a screw so that the tab 75 may be captivated to an under surface 14 of the table top 20 by screws or bolts. The tab may be attached 85 to the bezel 70 by other methods, such as welding, soldering or clamping.

In an alternative, the stud 84 and the tab 75 may not be present, and a hole may be provided in the location where the stud 84 is shown. A bolt or screw may be used to fasten the table bezel 70 to the table top 20. Where a fastener such as bolt or screw is inserted through a hole in the surface of the table bezel 70, the hole is spaced from the periphery 73 of the table bezel 70 so that the inserted fastener may engage the table top 20. That is, the hole may be positioned so that a screw or bolt inserted therein is positioned over the table top 12 and not over the aperture 23. A combination of the methods, or similar methods, may be used to attach the bezel 70 to the table top 20.

In another aspect, the holes may be positioned to have a pattern corresponding to a pattern of apertures in the shuffler 50 (not shown) so that bolts inserted into the holes may engage treaded portions of the apertures such that the shuffler is suspended from the table bezel 70. In such an installation, it may be sufficient for the weight of the shuffler 50 to captivate the table bezel 70 to the table top 20 without further fasteners.

Figure 5A:
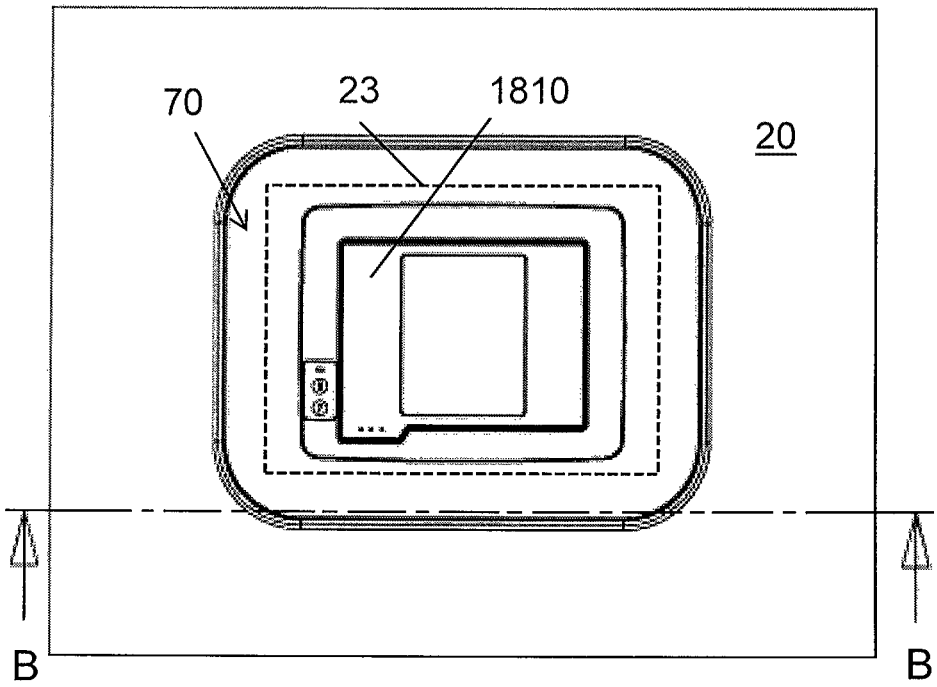
FIG. 5 shows (A) a detail top view of a table mounting bezel mounted to a table top, and (B) a side elevation cross section view of the bezel, showing the shuffler and other mounting details.
Figure 5B:
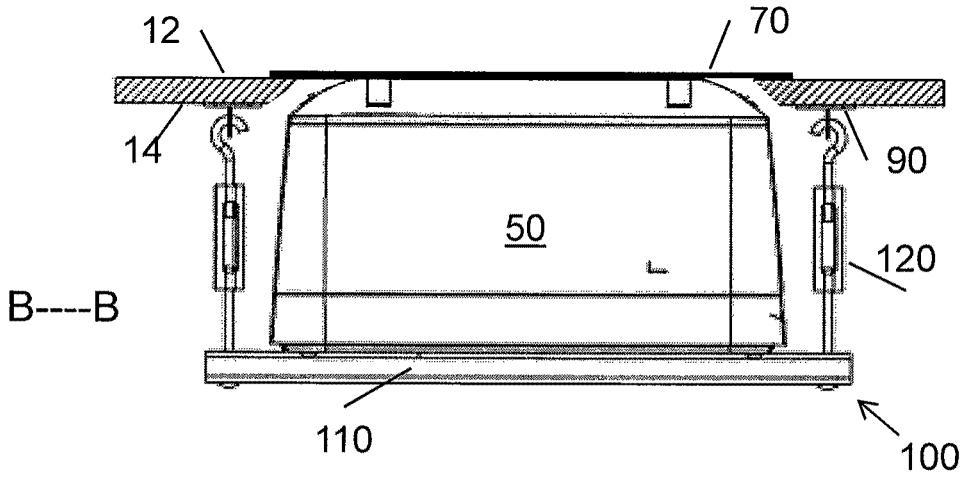

FIG. 5 shows a further aspect of the mounting of the shuffler 50 to the table 20. The table bezel 70 may be captivated to the table top 20 by placing the table bezel 70 above the aperture 23, with the tabs 75 extending into the aperture 23 from the top surface 12 to the bottom surface 14 of the table top 20. The tabs project below the bottom surface 14, and may be bent so as to have a portion of each tab 75 parallel to the bottom surface 14. The tabs 75 may be bent or formed and manipulated so that the table bezel 70 periphery covers the edges of the aperture 23, and screws, bolts, or other fasteners may be used to captivate the bezel 70 so that a lower surface of the bezel 70 is in contact with the top surface 12 of the table top 20.

The shuffler 50 may then be positioned so as to be accessible through the aperture 72 in the table bezel 70 so that the cover 1810 may be accessed and opened. The shuffler 50 may be held in this position by a support mechanism 100. In this example, the support mechanism may be a bar 110, angle iron, or plate, disposed beneath the lower surface of the shuffler 50, and being suspended from a pair of brackets 90 attached to the under surface 14 by a turnbuckle 120. A top end of the turnbuckle 120 may be a "J" hook, sized and dimensioned so as to engage with the bracket 90, which may be a two-hole D-ring hanger (OOK SKU #50207, available from Impex Systems Group, Inc, Miami, Fla.), or similar device affixed to the underside of the table top. A bottom end of the turnbuckle 120 may be, for example, a threaded stub end passing through a hole in the bar 110, and captivated to the bar 110 by nuts.

Once the "J" hook is engaged with the bracket 90, the turnbuckle mechanism 120 may be adjusted so as to shorten the vertical distance between the bar 110 and the bottom side 14 of the table top 20. After sufficient turning of the turnbuckle 120, the bar 110 will be in contact with a bottom surface of the shuffler 50, and a portion of the top of the shuffler 50, for example, the shuffler bezel 1840, may be in contact with the under surface of the table bezel 70. In this state, the cover 1810 of the shuffler 50 is accessible through the aperture 72 in the bezel 70, as mounted to the table top 20, and the support mechanism 100 holds the shuffler 50 in place and serves to resist any additional downward force exerted by the user when, for example, closing the cover 1810, or pressing a button 1841.

As the minimization of the area of the table occupied by the table bezel 70 may be a design objective, the dimensions of the aperture 23 may also be reduced. Where the peripheral dimensions, in a horizontal plane, of the shuffler 50 are greater than the corresponding peripheral dimensions of the aperture 23, the shuffler may contact the underside of the table along a portion of the aperture before the bezel 1810 of the shuffler 50 is in position in approximate contact with the underside of the table bezel 1810. This would occur particularly for table tops 20 having a significant thickness. Instead of forming the aperture 23 in the table top 20 using a cut that is orthogonal to the table top 20, the cutting device may be oriented such that an angle of, for example, 45° is made with respect to the table top 20, and the aperture 23 is smaller at the top surface 12 than at the bottom surface 14. This angled cut may be used in one or both of the opposing sides of the cut made to form the aperture 23.

The support mechanism 100 is shown as a bar 110 and turnbuckle 120 arrangement. However, the bar 110 may be replaced by a plate, or angle iron, and the plate may be attached to the underside of the table surface 14 by a plurality of turnbuckles, straps, or other attachment techniques.

Alternatively, a U-bracket may be provided such that the bottom of the U bracket supports the bottom of the shuffler 50, and the upper portion of the U bracket may have flanges that may be screwed or bolted to the table. The dimensions of the U-bracket may be fixed, as in an example where the thickness of the table is known. Alternatively, standoffs, spacers or shims may be placed between the flanges and the table top, or between the bottom of the shuffler and the U bracket so as to accommodate a variety of table top thicknesses, or manufacturing tolerances.

In another aspect, a compressible or resilient shim may be provided between the underside of the bezel 70 and the top surface 12 of the table top 20. The shim may be made of a compressible material, such as rubber, plastic or foam, so as to accommodate minor differences in nominal dimensions.

In yet another aspect, the resilient material may be provided in the region surrounding the underside of the inner periphery 72 of the table bezel 70 so as to cushion the contact area between the shuffler bezel 1840 and the table bezel 70.

In a further aspect, a ridge or rim may be provided between the outer periphery 74 and the inner periphery 72 of the table bezel 70. The rim may serve to prevent liquids or stray cards from entering the shuffler 50 through the aperture 72 along the table top 12.

In still another aspect, shown in FIG. 6, a table bezel 70 has an aperture 73 in the surface thereof, the aperture being sized and dimensioned such that a portion of a shuffler apparatus 50, mountable below the table top 20, is accessible through the aperture 73. The cover 1810 and a portion of the shuffler housing, which may be the shuffler bezel 1840, may be surrounded by the periphery 73 of the aperture 72 in the table bezel 70. This is similar to the previous examples.

A bracket assembly 200, may be, for example, one or more pieces of sheet metal or other suitable structural material that is formed into a generally "U" shape, sized and dimensioned to permit the shuffler 50 to be inserted therein. The dimensions of the bracket 200 need only be sufficient to allow the shuffler 50 to be inserted in one orientation; however, this is not a requirement. That is, the bracket 200 may support the shuffler 50 where the bracket 200 is oriented in a longitudinal or transverse direction with respect to the longer peripheral dimension of the base. The longitudinal position is shown in FIG. 7B.

A top portion of the bracket 200 may be formed so as to provide an attachment interface 210 to the bottom surface of the bezel 70. Any suitable fastening device may be used. For example, the stud 84, previously described, may pass through a hole in the surface 210 and be secured by a nut. Alternatively, arrangements previously described may also be used. The aperture 23 in the table top 20 may be smaller than a dimension of the shuffler 50 in any of the dimensions of the shuffler in a plane parallel thereto.

The aperture 23 in the table top 20 may have a beveled edge along at least a length of opposing sides thereof so as to accommodate the shuffler 50 when the shuffler 50 has dimensions such that an interference fit with a thick table top 20 occurs. For the particular shuffler design shown in FIG. 1, the slope of the surface 1842 in the direction of the narrower width of the shuffler 50 is shallower than that in the width direction transverse thereto. In such a circumstance the shorter length edge of the aperture 23 may be beveled so as to permit the shuffler 50 to be introduced into the aperture 23 far enough to come in contact with the lower surface of the table bezel 70. The angle of the bevel may be selected based on the specific dimensions of the shuffler 50 and the thickness of the table top 20. However, as a practical matter, an angle of 45° may be selected as convenient for manufacturing or aftermarket sales installation.

The shuffler 50 may be installed by placing the bezel 70 over the aperture 23 in the table top 20, and then placing the shuffler 50 beneath the table top 20 so that the cover 1810 of the shuffler 50 is aligned with the aperture 73 in the bezel 70, and raising the shuffler 50 and "U" bracket 200 so that the fasteners on the bottom of the bezel 70 engage with the fastening mechanism of the U bracket. In the situation where the fasteners on the bottom of the bezel 70 are studs 84, a nut, may captivate the U-bracket 200 to the bottom of the bezel 70.

When the "U" bracket 200 is captivated to the bezel 70 and the shuffler 50 is situated therebetween, the shuffler 50 may then be supported by the bezel 70 and hang through the opening in the table top 20. The U bracket may be fabricated from a single piece of material or assembled from multiple pieces by bolting, screwing, welding, or the like.

The arrangement may be maintained in place by the force of gravity pressing a portion of the bottom surface of the table bezel 70 against the top surface 12, by screws inserted into holes in the mounting plate 70 engaging with the table top 20, or by a flange or other structure associated with either the hanger assembly 200 or straps connected to studs 84 on the bottom of the mounting plate 70. The entire assembly may be permitted to move somewhat in the horizontal direction, as the dimensions of the mounting plate 70 may prevent the apparatus from falling through the aperture in the table top.

Figure 6A:
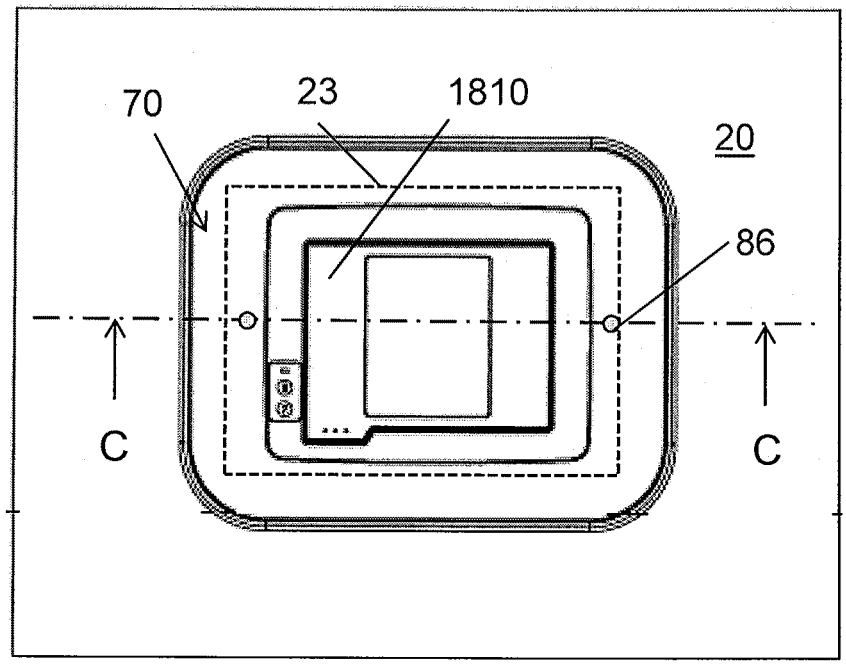
FIG. 6 shows (A) a top view of another example of a table bezel mounted to a table top; and (B) a side elevation cross section view showing the a shuffler support bracket installed to a table bezel, without a shuffler being shown.
Figure 6B:
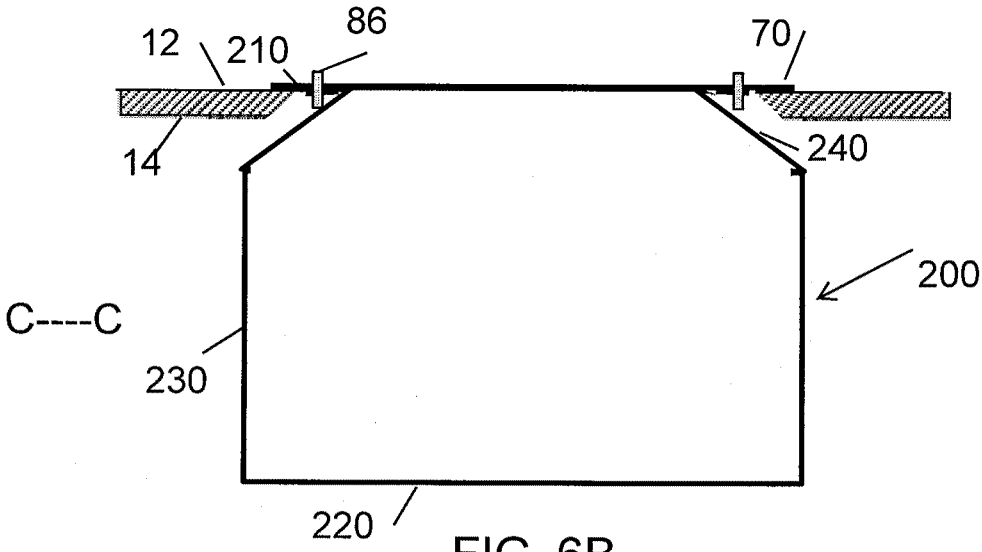

For each of the support assemblies as shown in FIG. 5 and FIG. 6, another exterior housing may be provided for mounting under the table so that noise abatement techniques may be used. For example, a box (not shown), open at the top may be secured between the bar 110 and a bottom of the shuffler assembly 50, so as to surround the shuffler assembly 50 and extend upwards towards the bottom surface 14 of the table. The height of the box may be such that the top ends of the box sides contact the under surface 14, or are separated therefrom by a small gap. The box may be fabricated of sound deadening material. Alternatively, a second bar and turnbuckle assembly may be used to support the box in contact with the bottom surface 14 of the table and the height of the box is such that a separation exists between the bottom surface of the box and the bar 110 supporting the shuffler assembly 50 when the top edges of the box are in contact with the bottom surface 14 of the table. Other support arrangements may be used.

In another aspect, a table 5 is provided, the table having a table top in which an aperture 23 is formed. At least one of the aperture linear dimensions may be smaller than the maximum dimension of the shuffler 50 in a plane parallel to the table top 20. The table bezel plate 70 is sized and dimensioned so that an aperture 11 in the shuffler 50 may be surrounded by the aperture 73 in the table bezel plate 70, and that the outer periphery 74 of the table bezel plate 70 masks the periphery of the aperture 23 in the table top 20.

Although the present invention has been explained by way of the examples described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An apparatus for mounting a card shuffler to a table top, comprising:

a plate sized and dimensioned so as to mask a periphery of an aperture in the table top, and having an aperture therein sized and dimensioned to accommodate a card of a deck of cards disposed parallel to the plate; and, a shuffler support, comprising:

a linear support, positionable to oppose a lower surface of the card shuffler;

a pair of turnbuckles; and, a pair of brackets, wherein a first end of each turnbuckle of the pair of turnbuckles is attached to one end portion of the linear support, and a second end of each turnbuckle is adapted to engage with a bracket of the pair of brackets, wherein a largest peripheral dimension of the aperture in the table top is smaller than a largest corresponding peripheral dimension of the card shuffler in a plane parallel to the table top.

2. The apparatus of claim 1, wherein the plate is adapted to be captivated to the table top.

3. The apparatus of claim 2, wherein the shuffler support is adapted to maintain an upper portion of the shuffler in contact with a lower surface of the plate.

4. The apparatus of claim 1, wherein the brackets are picture hanging loops.

5. The apparatus of claim 1, wherein the linear support is one of a bar, angle iron, or plate.

6. A table, comprising:

a table top having an aperture formed therein; and, a card shuffler assembly, further comprising:

a card shuffler having an aperture in a top thereof capable of accepting a deck of cards;

a plate sized and dimensioned so as to mask a periphery of the aperture in the table top, and having an aperture sized and dimensioned to accommodate a card of the deck of cards when the card is disposed parallel to the table top; and, a shuffler support, comprising at least two turnbuckles attachable to an underside to the table top, and having one of a bar, angle iron or plate connected to the turnbuckles and disposable to support the card shuffler so the top of the card shuffler comes in contact with the underside of the plate;

wherein a largest peripheral dimension of the aperture in the table top is smaller than a largest corresponding peripheral dimension of the card shuffler in a plane parallel to the table top.

7. The table of claim 6, wherein the plate is captivated to the table top.

8. The table of claim 7, wherein the shuffler support maintains an upper portion of the shuffler in contact with a lower surface of the plate.

9. A mounting kit for a card shuffler to a mounting surface, the kit comprising:

a plate for covering an aperture in a mounting surface, and having an aperture therein sized and dimensioned to permit access to a card loading compartment of the card shuffler when the card shuffler is mounted beneath the plate;

a support device adapted to captivate the card shuffler to an underside of the mounting surface, the support device comprising at least two turnbuckles attachable to the underside of the mounting surface, and having one of a bar, angle iron or plate connectable to the turnbuckles and disposable to support the card shuffler.

* * * * *